US005689791A

United States Patent [19]

Swift

[11] Patent Number: 5,689,791

[45] Date of Patent: Nov. 18, 1997

[54] ELECTRICALLY CONDUCTIVE FIBERS

[75] Inventor: Joseph A. Swift, Ontario, N.Y.

[73] Assignee: Xerox Corporation, Stamford, Conn.

[21] Appl. No.: 673,531

[22] Filed: Jul. 1, 1996

[51] Int. Cl.[6] ..... G03G 21/00

[52] U.S. Cl. ..... 399/353

[58] Field of Search ..... 355/302, 296, 355/297, 301; 15/256.5, 256.51, 256.52, 1.51; 118/652; 399/353, 354

[56] References Cited

U.S. PATENT DOCUMENTS

| | | | |
|---|---|---|---|
| 3,610,693 | 10/1971 | Solarek | 355/301 X |
| 3,722,018 | 3/1973 | Fisher | 15/1.51 |
| 3,823,035 | 7/1974 | Sanders et al. | 428/368 |
| 4,319,831 | 3/1982 | Matsui et al. | 355/303 |
| 4,483,611 | 11/1984 | Matsuura et al. | 355/302 |
| 4,706,320 | 11/1987 | Swift | 15/1.51 |
| 4,741,942 | 5/1988 | Swift | 428/82 |
| 4,835,807 | 6/1989 | Swift | 15/1.51 |
| 5,175,591 | 12/1992 | Dunn et al. | 355/297 |
| 5,576,822 | 11/1996 | Lindblad et al. | 399/354 |

FOREIGN PATENT DOCUMENTS

| | | |
|---|---|---|
| 60-159774 | 8/1985 | Japan . |
| 61-75810 | 4/1986 | Japan . |
| 4-274477 | 9/1992 | Japan . |

*Primary Examiner*—Arthur T. Grimley
*Assistant Examiner*—Sophia S. Chen
*Attorney, Agent, or Firm*—Annette L. Bade

[57] ABSTRACT

Electroconductive fibers with electrically conductive filler suffused through or coated upon the surface of the filamentary polymer substrate and being present inside the filamentary polymer substrate as a uniformly dispersed phase adhered to the polymer substrate in an annular region located at the periphery of the filament and extending inwardly along the diameter thereof, wherein the electroconductive fibers are suitable for miniature cleaning brushes for an image forming apparatus are disclosed.

28 Claims, 3 Drawing Sheets

ELECTRICALLY CONDUCTIVE FIBERS

BACKGROUND OF THE INVENTION

The present invention relates to brushes, especially cleaning brushes comprising electroconductive fibers for use in image forming and, in embodiments, electrostatographic reproducing apparatii. In embodiments, the cleaning brushes contain electroconductive fibers having small diameters. The electroconductive fibers of the cleaning brushes of the present invention comprise, in embodiments, a filamentary polymer substrate having finely divided electrically conductive particles suffused through, or coated onto, or dispersed into the surface of the filamentary polymer substrate, wherein the conductive particles are present inside or within the filamentary polymer substrate as a uniformly dispersed phase attached to the polymer substrate in an annular region located at the periphery of the filament and extending inwardly along the diameter thereof. The electroconductive fibers are suitable for small diameter cleaning brushes for electrostatographic reproducing, printing and imaging apparatii.

In known electrostatographic reproducing apparatii, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam. Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development, the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure. Usually, all of the developed toner does not transfer to the copy paper, and therefore cleaning of the photoreceptor surface is required prior to the point where the photoreceptor enters the next charge and expose cycle.

Commercial embodiments of the above general processor have taken various forms and in particular various techniques for cleaning the photoreceptor have been used. One of the most common and commercially successful cleaning techniques has been the use of a cylindrical brush with soft bristles such as rabbit fur which has suitable triboelectric characteristics. The bristles are soft so that as the brush is rotated in contact with the photoconductive surface to be cleaned, the fibers continually wipe across the photoconductive surface to produce the desired cleaning without significant wear or abrasion to the photoreceptor.

Subsequent developments in cleaning techniques and apparatii, in addition to relying on the physical contacting of the surface to be cleaned to remove the toner particles, also rely on establishing electrostatic fields by electrically biasing one or more members of the cleaning system to establish a field between a conductive brush and the insulative imaging surface so that the toner on the imaging surface is attracted to the brush by electrostatic forces. Thus, if the toner on the photoreceptor is positively charged then the bias on the brush would be negative. Therefore, the creation of a sufficient electrostatic field between the brush and imaging surface to achieve the desired cleaning effect is accomplished by applying a DC voltage to the brush. Typical examples of such techniques are described in U.S. Pat. Nos. 3,572,923 to Fisher et al. and 3,722,018 to Fisher. A further refinement of these electrostatic brush devices is described in U.S. Pat. No. 4,494,863 to Laing wherein in addition to establishing an electric field between the imaging member and the brush to attract charged toner particles from the imaging member, a pair of detoning rolls, one for removing toner from the biased cleaner brush and the other for removing debris such as paper fibers and clay from the brush are provided. The two detoning rolls are electrically biased so that one of them attracts toner from the brush while the other one attracts debris thereby permitting toner to be used without degradation of copy quality while the debris can be discarded.

In most brush cleaning systems, a balance between cleaning performance which requires the removal of toner and other debris from a delicate imaging member, versus wearing abrasion and filming on the imaging member must be maintained at all times. The electrostatic brush techniques such as those described by Fisher, Fisher et al and Laing have the benefit that the brush may be rotated relatively slowly and, as a result, the process speed may be increased while maintaining cleaning brush speed at the same relative rate. However, a further problem with abrasion may be present with the advent of photoconductive materials which are not as resistant to abrasion as materials of the past. For example, photoreceptors of the type disclosed in U.S. Pat. No. 4,265,990 to Stolka et al. which is directed to photoconductors comprising an electrically conductive substrate, a charge generator layer with photoconductive particles dispersed therein in an insulating organic resin and a charge transport layer, are particularly susceptible to abrasion damage by mechanical brush cleaners that typically revolve at high rotational velocities, and by large diameter brush fibers which are characteristically stiff.

Initially, electrostatic brush cleaning devices employed brushes made with metal fibers such as stainless steel fibers because of their ready availability. While effective for some applications, they suffer certain deficiencies in that in addition to being relatively abrasive, there is a tendency for the stainless steel fibers to entangle and compression set, thereby causing deformation of the brush and premature shortfalls in cleaner performance. Furthermore, since the metal fibers are highly conductive, if any one filament contacts the ground surface along the edge of the photoreceptor, it would short out the brush providing a generalized cleaning failure. In addition, loose fibers would short out other electrical elements such as corotrons, switches, printed wiring boards, etc. Moreover, since stainless steel fibers are sold on a weight basis, they become very costly in comparison to other fibers, such as polymeric type fibers which have a much lower specific gravity. Accordingly, there has been a desire and a need to provide an alternative more economical, long life, stable electrically conductive fiber.

U.S. Pat. No. 4,319,831 to Matsui et al. describes a cleaning brush for a copying device wherein the brush is composed of composite conductive fibers consisting of at least one conductive layer containing conductive fine particles and at least one non-conductive layer in a monofilament. The electrical resistance of the conductive fibers is less than $10^{15}$ ohms/cm. The fineness of the fibers is from 3 to 300 denier and the length of the piles is from 3 to 50 mm. The percentage of the outer surface area occupied by the conductive layer is not more than 50%. Conductive carbon black particles may be used with a number of synthetic resins including polyamides. The disclosure of this reference is hereby incorporated by reference in its entirety.

U.S. Pat. No. 4,741,942 to Swift discloses a cylindrical fiber brush useful in electrostatic charging and cleaning in an electrostatographic imaging process comprising an elongated cylindrical core having bound thereto a spirally wound conductive pile fabric strip forming a spiral seam between adjacent windings of the fabric strip, the fiber fill density of the fabric strip at the strip edge being at least double the fiber fill density in the center portion of the fabric strip. It is disclosed that the cleaning brush has an outside diameter of 2.5 to 3 inches with a pile height of about ¼ to 1 inch and a pile fiber fill density of about 14,000 to 40,000 fibers per square inch of 7 to about 25 denier per filament fibers. The fibers of the cleaning brushes have a diameter of about 30 to 50 microns. The disclosure of this reference is hereby incorporated by reference in its entirety.

U.S. Pat. No. 4,835,807 also to Swift discloses cleaning brushes containing electroconductive fibers, wherein the brushes are useful as electrostatic cleaning brushes for use in electrostatographic reproducing apparatus. The individual brush fibers comprise a filamentary polymer substrate having finely divided electrically conductive particles of carbon black suffused through the surface of the filamentary polymer substrate and are present inside the filamentary polymer substrate as a uniformly dispersed phase independent of the polymer substrate in an annular region located at the periphery of the filament and extending inwardly along the length thereof. The electrically conductive carbon black is present in an amount sufficient to render the electrical resistance of the fiber of from about $1\times10^3$ ohms/cm to about $1\times10^9$ ohms/cm. The cleaning brush has an outside diameter of from 1 to 3 inches and a pile height of ¼ inch to 1 inch. The fiber fill density is 20,000 to 50,000 fibers per square inch and the fineness is about 5 to about 25 denier per filament fiber. The fiber diameter is 25 to 55 microns. The pile height is from about 6 to 20 mm. The disclosure of this reference is hereby incorporated by reference in its entirety.

Processes for producing fibers useful in the cleaning assemblies of electostatographic cleaning apparatii are disclosed in U.S. Pat. No. 3,823,035 and 4,255,487, the disclosures of which are hereby incorporated by reference in their entireties. Briefly, the process disclosed consists of preparing fibers by applying to a nylon filamentary polymer substrate a dispersion of carbon black in a solvent for the filamentary polymer substrate which does not dissolve or react with the conductive particles and removing the solvent from the filamentary polymer substrate after the carbon black particles have penetrated the periphery of the filamentary polymer substrate and before the structural integrity of the filamentary polymer substrate has been destroyed. Typically, formic acid is used as a solvent in the application of carbon black particles to either nylon 6 or nylon 66. Alternatively, the dispersion may contain powdered nylon. The fibers have sufficient elastic properties so as not to flex fatigue. Accordingly, with repeated deformation by contact with the imaging member, the fibers retain their original configuration.

As electronics are designed to be smaller and more compact, the xerographic machines that use these electronics may also be much smaller and more compact. However, a problem results in that the required mechanical machinery, components, and subsystems typically have not kept pace with the rapid movement towards miniaturization of electronics and have therefore impeded the ability to miniaturize the overall machine size. Thus, the diameter of known cleaning brushes are larger than desired. Thus, smaller brushes and correspondingly smaller brush fibers are needed which are suitable for smaller sized machines and which are able to maintain the properties of sufficient cleaning without damage to photoreceptor surfaces. In addition, there is a need to produce brushes and brush fibers with decreased costs. In addition, when the need arises for two brushes to function in the cleaning assembly of a smaller apparatus, the known brushes do not fit or function well in a small, compact size.

There exists a need for a sufficiently miniaturized cleaning brush to be used in image forming apparatii, which contains suitable conductive brush fibers having a decreased fineness and a decreased pile height in order to optimize cleaning in an electrostatographic process, leaving little or no residual toner on the transfer surface. There also exists a need for a miniaturized cleaner brush with significantly higher fiber fill density in order to enable effective cleaning at substantially reduced rotational speeds. There further exists a need to produce smaller, more compact cleaning brushes and brush fibers with a decrease in overall cost. These and other needs are achievable with the present invention in embodiments thereof.

Accordingly, the present invention, in embodiments, solves the need for smaller cleaning brushes and fibers for use in smaller, more compact imaging forming apparatii by providing a cleaning brush comprising sufficiently miniaturized conductive fibers, wherein the fibers comprise a filamentary polymer substrate containing electrically conductive filler in an amount sufficient to render the electrical resistance of the individual fibers from about $1\times10^3$ ohms/cm to about $1\times10^{12}$ ohms/cm, wherein the conductive filler is oriented in a dispersed phase independent of and attached to the polymer substrate located at the periphery of the filament.

SUMMARY OF THE INVENTION

Examples of objects of the present invention include:

It is an object of the present invention to provide brushes and methods thereof with many of the advantages indicated herein.

Another object of the present invention is to provide a cleaning brush having electroconductive fibers for use as cleaning brushes in an image forming apparatus, wherein the damage to the image forming portion of the apparatus is decreased.

It is yet another object of the present invention to provide cleaning brushes having electroconductive fibers and which brushes can be used as cleaning brushes in an electrostatographic apparatus, and which provide optimal cleaning during the image forming process by decreasing the amount of residual toner left on the transfer surface.

Yet another object of the present invention is to provide cleaning brushes having electroconductive fibers for use as cleaning brushes in an image forming apparatus, which have an extended and/or improved cleaning life.

Still a further object of the present invention is to provide cleaning brushes having electroconductive fibers for use as cleaning brushes in an image forming apparatus, wherein the fibers are soft and provide substantially no abrasive damage or filming of the imaging surface.

Another object of the present invention is to provide cleaning brushes having electroconductive fibers for use as cleaning brushes in an image forming apparatus, wherein the fibers are durable and nonsetting at typical nip interfaces and at the desired relative velocities.

A further object of the present invention is to provide cleaning brushes having electroconductive fibers for use as cleaning brushes in an image forming apparatus suitable for use in small diameter cleaning brushes.

Yet a further object of the present invention is to provide cleaning brushes having a very high number of electroconductive fibers for use as cleaning brushes in an image forming apparatus suitable for use in small diameter cleaning brushes capable of very slow rotational velocities.

Still yet another object of the present invention is to provide cleaning brushes having electroconductive fibers for use as cleaning brushes in an image forming apparatus which allow for a savings in overall costs.

Many of the above objects have been met by the present invention, in embodiments, which include: a miniature cleaning brush having a small diameter for use in electrostatographic reproducing apparatus comprising fine diameter electroconductive fibers, wherein said fibers comprise a filamentary polymer substrate having finely divided electrically conductive filler particles suffused through the filamentary polymer substrate and being present inside the filamentary polymer substrate as a uniformly dispersed phase independent of the polymer substrate in an annular region located at the periphery of the filament and extending inward along the diameter thereof, wherein said electrically conductive particles are present in an amount sufficient to render the electrical resistance of the fiber from about $1\times10^3$ ohms/cm to about $1\times10^{12}$ ohms/cm.

Many of the above objects have also been met by the present invention, in embodiments, which include: a compact image forming apparatus for forming images on a recording medium comprising:

a charge-retentive surface to receive an electrostatic latent image thereon;

a development means to apply toner to said charge-retentive surface to develop said electrostatic latent image to form a developed image on said charge retentive surface;

transfer means to transfer the developed image from said charge retentive surface to a substrate; and cleaning means for removing residual toner and debris from said charge-retentive surface after the developed image has been transferred thereon, said cleaning member comprising a cleaning brush having a small diameter for use in said compact image forming apparatus comprising fine diameter electroconductive fibers, wherein said fibers comprise a filamentary polymer substrate having finely divided electrically conductive filler particles suffused through the filamentary polymer substrate and being present inside the filamentary polymer substrate as a uniformly dispersed phase independent of the polymer substrate in an annular region located at the periphery of the filament and extending inwardly along the diameter thereof, wherein said electrically conductive particles are present in an amount sufficient to render the electrical resistance of the fiber from about $1\times10^3$ ohms/cm to about $1\times10^{12}$ ohms/cm.

BRIEF DESCRIPTION OF THE DRAWINGS

The above aspects of the present invention will become apparent as the following description proceeds upon reference to the drawings in which.

DETAILED DESCRIPTION

For a general understanding of the features of the present invention, a description thereof will be made with reference to the drawings.

Figure 1:
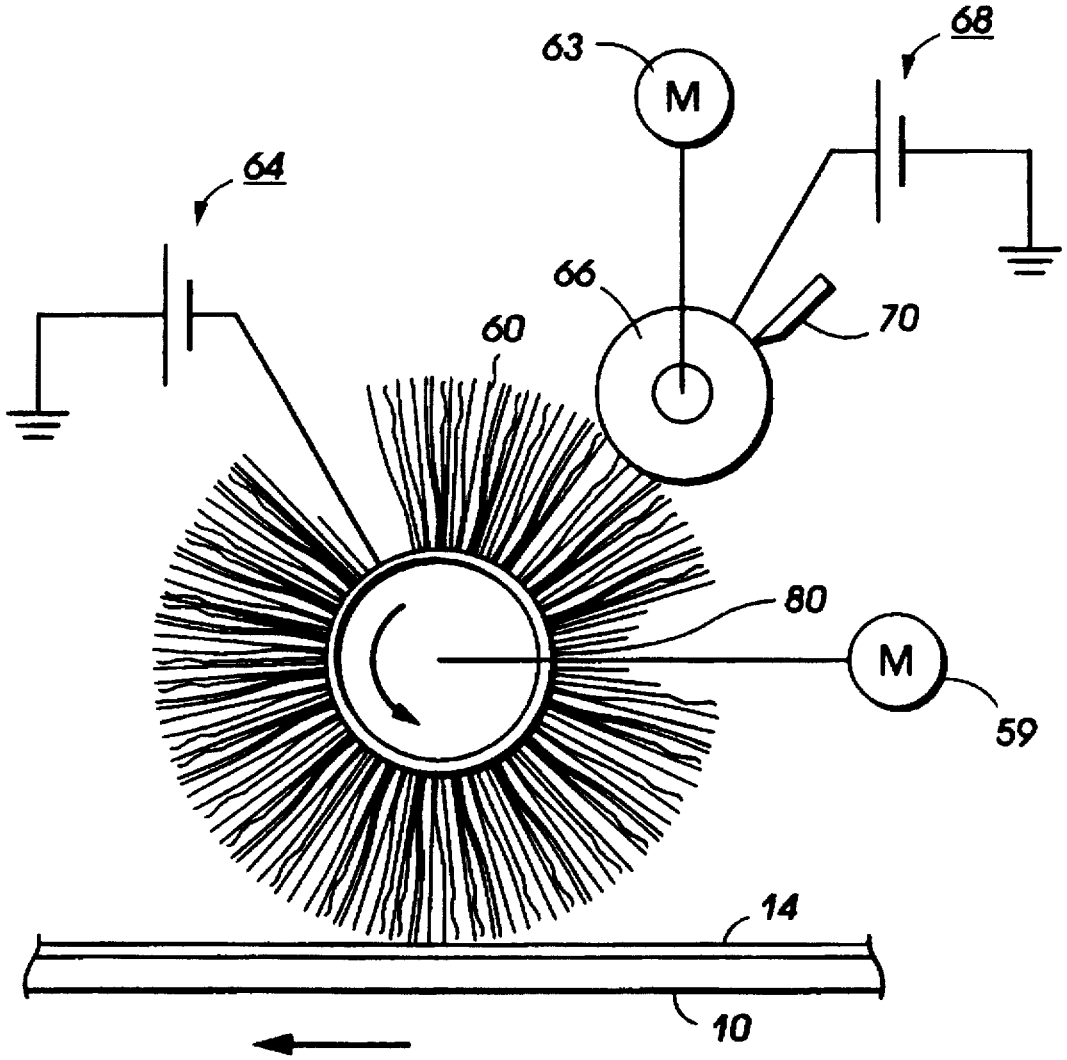
FIG. 1 is a schematic illustration of the electrostatic cleaning apparatus used in the machine illustrated in FIG. 1.

As illustrated in FIG. 1, a cleaning station comprises a miniaturized electrically conductive fiber brush 60 which is supported for rotation in contact with the photoconductive surface 14 by a motor 59. A source 64 of negative DC potential is operatively connected to the brush 60 such that an electric field is established between the insulating member 10 and the brush to thereby cause attraction of the positively charged toner particles from the surface 14. Typically, a voltage of the order of negative 250 volts is applied to the brush. An insulating detoning roll 66 is supported for rotation in contact with the conductive brush 60 and rotates at about twice the speed of the brush. A source of DC voltage 68 electrically biases the detoning roll 66 to a higher potential of the same polarity as the brush is biased. A scraper blade 70 contacts the roll 66 for removing the toner therefrom. Typically, the detoning roll 66 is fabricated from anodized aluminum whereby the surface of the roll contains an oxide layer about 50 microns thick and is capable of leaking charge to preclude excessive charge buildup on the detoning roll. The detoning roll is supported for rotation by a motor 63. In the cleaning brush configuration of FIG. 1, the photoconductive belt moves at a speed of about 10 to 25 preferably 11.0 inches per second while the brush rotates at a speed of about 3.0 to 60, preferably about 18.5 inches per second opposite the direction of the photoconductive belt movement. The primary cleaning mechanism is by electrostatic attraction of toner to the tips of the brush fibers and being subsequently removed from the brush fibers by the detoning roll from which the blade scrapes the cleaned toner off to an auger which transports it to a sump.

Alternatively, the cleaning device according to the present invention may include the use of a pair of detoning rolls, one for removing toner from a biased cleaner brush and the other removing debris such as wrong sign or reverse polarity toner, paper fibers, and clay from the brush in the manner previously discussed with regard to U.S. Pat. No. 4,494,863 to Laing. In this technique the two detoning rolls are electrically biased so that one of them attracts toner from the brush while the other one attracts debris. As a result the toner can be reused without degradation of copy quality while the debris can be discarded.

Various effective polymers may be used for the filamentary polymer substrate (1 in FIG. 4) of the present invention. In embodiments, the filamentary polymer substrate of the present invention can be any hydrocarbon thermoplastic polymer that is suitable for fiber formation of high molecular weight with aliphatic or aromatic hydrocarbon chains, or a copolymer of both aliphatic and aromatic chains. Suitable polymers include polymers synthesized from monomers of aliphatic or aromatic hydrocarbons and comprise molecular chains having from about 100 to about 50,000 carbon atoms to yield an average molecular weight of the polymer in the range from about 1,000 to about 1,000,000 and, preferably from about 200 to about 20,000 carbon atoms to result in an average molecular weight of from about 3,000 to about 300,000. Examples of filamentary polymers include polymers such as polyester; polyethylene; polypropylene; polyamides such as nylon 6, nylon 66, nylon 11, nylon 12, nylon 610, nylon 612, and the like; aromatic polyesters such as polyethylene terephthalate, polybutylene terephthalate, polyethylene oxybenzoate and the like; polyacrylonitriles; copolymers or mixtures consisting of polyamide, polyester and polyacrylonitrile; nylon copolymers such as nylon 6/nylon 66, nylon 6/polypropylene, and a nylon and polybutylene terephthalate; and celluloses such as rayons and acetates. Preferred polymers are the nylons, such as nylon 6, nylon 66, nylon 11, nylon 12, nylon 610, and nylon 612, and the polyesters such as polyethylene terephthalate and polybutylene terephthalate. Also preferred are copolymers of nylon 6 and another nylon such as nylon 66, nylon 11, nylon 12, nylon 610 or nylon 612; copolymers of nylon 66 and another nylon such as nylon 6, nylon 11, nylon 12, nylon 610 or nylon 612; and copolymers of nylon 6 or nylon 66 and polybutylene terephthalate. Particularly preferred are copolymers of nylon 6 and polybutylene terephthalate and copolymers of nylon 66 and polybutylene terephthalate. In a preferred embodiment, the cleaning brush contains fibers that are configured to have an outer conductive layer that covers from about 95 to about 100 percent, preferably from about 99 to about 100 percent of the perimeter of the fiber.

The electrically conductive filler particles are present in an amount sufficient to render the electrical resistance of the fibers to from about $1\times10^3$ ohms/cm to about $1\times10^{12}$ ohms/cm, preferably from about $1\times10^3$ to about $1\times10^9$ ohms/cm, and particularly preferred from about $1\times10^4$ to about $1\times10^7$ ohms/cm. As a result of the concentration of conductive filler on the outer portion of the fibers, the individual fibers generally have a nonconductive core portion with a thinner outer portion of conductive filler containing polymer having a resistance per unit length in the stated range. As a result of the structure, this value reflects the resistance per unit length of the periphery and provides a resistance per unit length of from about $2\times10^1$ ohms/cm to about $3\times10^7$ ohms/cm for 40 filament yarn. Preferably, the resistance per unit length of one filament is from about $1\times10^5$ to about $5\times10^6$ ohm/cm. In embodiments, the filler is present in an amount of from about 8 to about 75 percent by weight and preferably from about 10 to about 25 percent by weight of a suitable, fine particle size carbon black.

Figure 4:
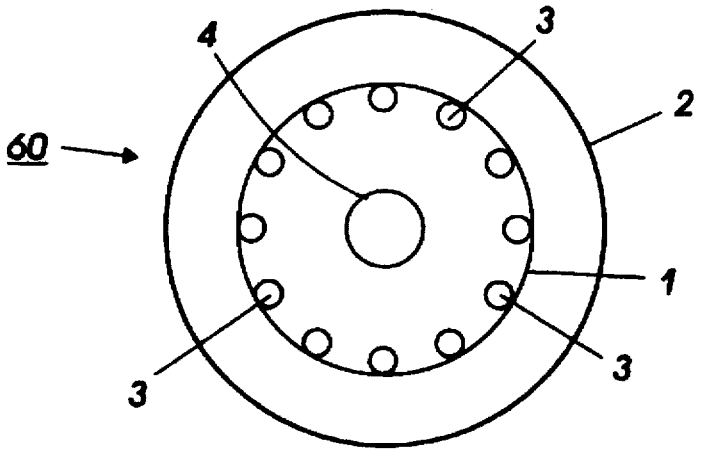
FIG. 4 is a cross-section of an embodiment of an individual electroconductive fiber of a cleaning brush in accordance with the present invention

The electrically conductive filler particles 3 in FIG. 4 are suffused through the filamentary polymer substrate and are present inside the filamentary polymer substrate as a uniformly dispersed phase independent of the polymer and in an annular region located at the periphery of the filament and extending inwardly along the width thereof. The resulting fibers comprise a central, nonconductive core 4 in FIG. 4. The filler is suffused through the filamentary polymer substrate in an annular region along the width of the filament by use of a solvent. The suffusion results in the conductive filler spreading through or diffusing into the polymer in a generally uniform dispersion. The electrically conductive particles are not located in the central part of the core.

The electrically conductive particles are finely divided, or uniformly dispersed, and preferably evenly spaced within the annular region at the periphery and extending inwardly along the length. The electrically conductive fillers are not located in one region of the fiber, but are spread apart, in an even dispersion.

The electrically conductive textile fibers which are useful in the present invention may be made according to the suffusion techniques described in U.S. Pat. No. 3,823,035 to Sanders and 4,255,487 also to Sanders. The disclosures of these patents are hereby incorporated by reference in their entirety. The solvent swelling and coating application techniques used for suffusion and described therein are suitable for any polymeric fiber where a suitable solvent system can be identified. The important features of the solvent system chosen require the solvent to swell the fiber substrate in a controllable manner and to serve as the liquid phase, application media for the carbon black filler or the carbon black plus polymer coating composition. The use of partial solvents that are liquids that only swell the substrate polymer, but do not completely dissolve the substrate polymer, may also be used to gain better control of the fiber coating process. The preferable solvents would be stable, nonflammable, and environmentally friendly, as well as non harmful to, nor interactive with, the coating process equipment typically employed in a commercial operation. In addition, commercially available fibers prepared according to these techniques may be available from BASF Corporation under the general designation F901 Static Control Yarn. These fibers, which are made from the above described suffusion process, are generally characterized as having a conductive coating (2 in FIG. 4) on the outer surface thereof where a solvent or partial solvent for the substrate is used to swell the substrate and provide the vehicle for coating deposition of the conductive filler thereto. The fibers according to the present invention have a layer wherein the electrically conductive filler particles have spread through or diffused into the fiber substrate itself. As a result, a very durable electroconductive outer portion on the fiber is present, particularly when nylon powder is added to the carbon black containing solvent.

Attention is directed to the aforementioned two patents to Sanders for further details concerning the fabrication of such fibers. Briefly, however, they can be prepared by applying to the filamentary polymer substrate a dispersion of the finely divided electrically conductive filler particles such as high conductivity, high surface area carbon black in a solvent for the filamentary polymer substrate which does not dissolve or react with the conductive particles, and removing the solvent from the filamentary polymer substrate after the filler particles have penetrated the periphery of the filamentary polymer substrate and before the structural integrity of the filamentary polymer substrate has been destroyed. Typically, formic acid, alone or in combination with other suitable organic acids, such as acetic acid, is used as a solvent in the application of filler particles to either nylon 6 or nylon 66 in the event these specific polymers are used in a particular embodiment. Alternatively, in the modified method described by both Sanders patents, the dispersion may contain powdered nylon which is similar to, or different from, the substrate nylon. for example, when nylon 6 is used as the substrate, nylon 66 can be incorporated into the conductive outer layer. In this case, the moisture uptake and consequent changes in mechanical properties of the composite fiber may be desirably reduced. The fibers have sufficient elastic and strength properties to allow pile fabric weaving and spiral brush manufacturing operations that they do not flex fatigue when used in a xerographic cleaning brush application. Accordingly, with repeated deformation and rotational contact with the imaging member, they retain their original configuration. Since the suffusion process provides an integral composite fiber, there is no significant debonding nor is there significant abrasive wear of the fibers.

Alternately, the outer conductive layer may be configured by melt application of a suitable polymer and conductive filler combination where heat is used to liquefy the coating composition to a viscosity low enough to be evenly applied to the substrate fiber. Likewise, the two layered fiber structure can be manufactured by the process known as bi-component melt spinning where two polymer phases, one with conductive filler and one without, are liquefied by melting and brought into mutual contact by extrusion through a multi-opening orifice. Upon cooling, the two layer structure resembles the same configuration as obtained by the above described suffusion process.

Suitable electrically conductive filler particles include carbon black, graphite, along with metal oxides including iron oxide, tin oxide, zinc oxide and tungsten oxide. Likewise, fine particles of intrinsically conductive polymers, such as polypyrrole and polyacetylene may be used. In a preferred embodiment, the filler is carbon black.

Figure 2:
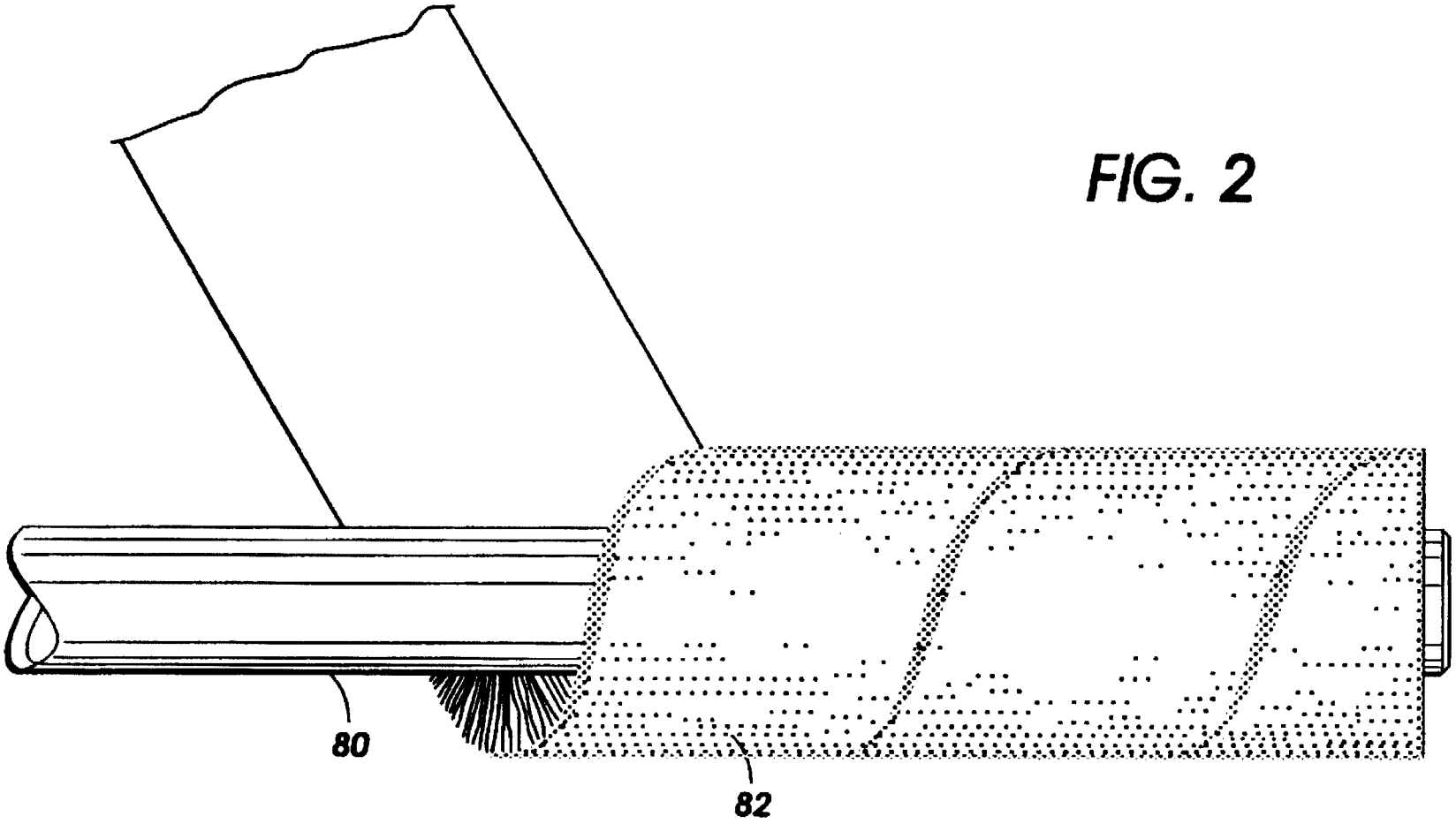
FIG. 2 is an isometric illustration of a cylindrical fiber brush according to the present invention.

The cleaning brush herein may be used in any suitable configuration, Typically, a cylindrical fiber brush comprising a spirally wound conductive pile fabric strip on a elongated cylindrical core in the manner illustrated in FIGS. 1 and 2 is used. Typically such a miniature brush diameter is small, for example, from about 0.1 to about 1.25 inches in diameter, preferably 0.2 to about 1.0 inches in diameter, and particularly preferred from about 0.2 to about 0.5 inches, and is composed of cardboard, epoxy or a phenolic impregnated paper, extruded thermoplastic material, pultruded thermosetting or thermoplastic resin containing fiberglass or carbon fiber reinforcement, or metal providing the necessary rigidity and dimensional stability for the brush to function well during its operation. While the core may be either electrically conductive or non-conductive, it is preferred that it be electrically insulating.

FIG. 2 is a schematic illustration of a spirally wound conductive pile fabric strip on a cylindrical core 80 with a cut plush pile woven fabric strip 82 spirally wound about the core to form a miniature cleaner brush.

Typically, the miniature cleaning brush of this invention has a fiber fill density of from about 50,000 fibers to about 350,000 fibers per square inch, and preferably from about 80,000 to about 200,000 fibers per square inch, and particularly preferred from about 100,000 to about 150,000 fibers per square inch. The fineness of the fibers is from about 0.1 to about 11 denier per filament fiber, preferably from about 0.5 to about 5 denier, and particularly preferred 0.7 to about 3 denier in the fabric strip for optimum cleaning performance. The diameter of the individual fibers is fine, for example, from about 5 to about 38 microns, preferably from about 11 to about 25 microns. The pile height of the brush may be from about 0.1 to about 20 mm and is preferably from about 0.5 to about 9 mm, particularly preferred of from about 1 to about 7 or 3 to about 5 mm, in providing optimum high process speed cleaning performance. The selection of fiber denier and fiber fill density within the fabric layer is made to correspond to the final choice in fiber length and cleaning performance with, in general, shorter fiber lengths requiring smaller fiber deniers. Some factors to consider in determining the fiber denier and fiber fill density include the amount of fiber deflection and the inelastic yield or permanent deformation produced by the level of induced strain energy in the fiber at the given deflection, as well as the desire to minimize wear and abrasion of the photoreceptor and fiber surfaces while maximizing cleaning performance. The pile height is related to the fiber length in that the fiber length is defined as including the distance the pile fiber extends into the backing fabric; this distance usually being about 1 mm or less. The pile height is considered to be the fiber's projected length above the backing fabric exclusive of the backing thickness.

The cylindrical fiber brush according to the present invention may be fabricated using conventional techniques that are well known in the art. For example, it can be prepared by conventional knitting or tuft insertion processes as well as the preferred weaving process. The initial step of weaving fabric is accomplished from conventional techniques wherein it can be woven in strips on a narrow loom, for example, or be woven in wider strips on a wide loom leaving spaces between the strips. Alternatively, a plush pile woven fabric is produced such that the fiber fill density of the fabric strip at the strip edges is a least double the fiber fill density in the center portion of the fabric strip in the manner described in U.S. Pat. No. 4,706,320, the disclosure of which is incorporated herein in its entirety.

Figure 3:
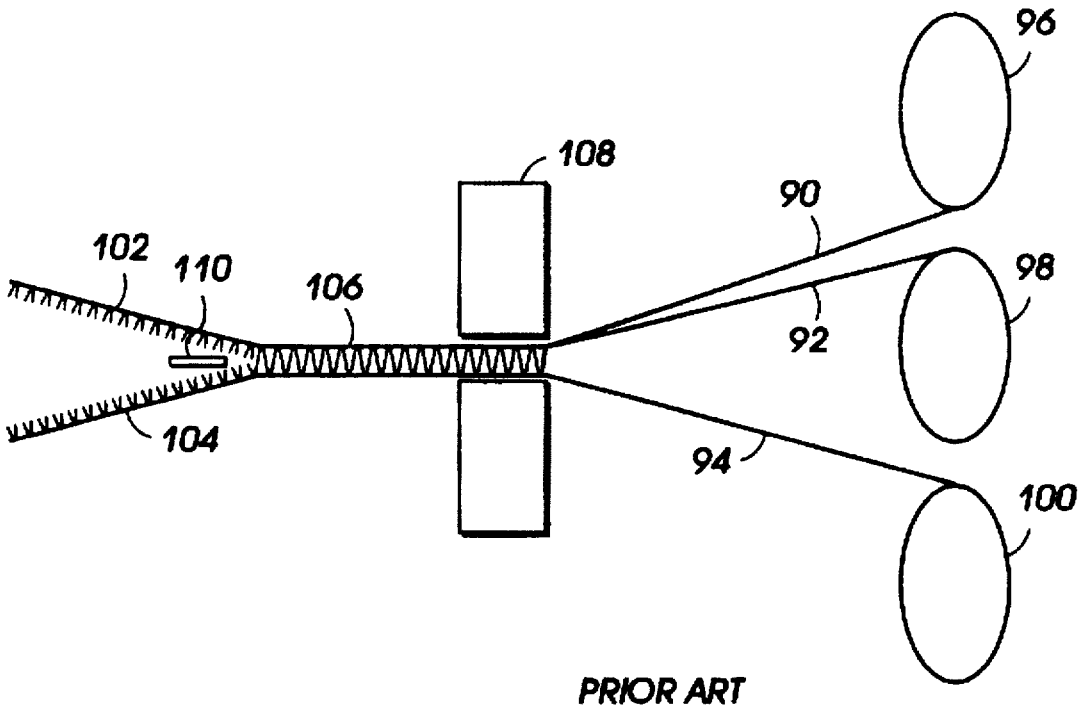
FIG. 3 is a schematic illustration of a conventional weaving system.

FIG. 3 schematically illustrates a conventional weaving apparatus where fabrics can be made using any suitable shuttle or shuttleless pile weaving loom. A woven fabric is defined as a planar structure produced by interlacing two or more sets of yarns whereby the yarns pass each other essentially at right angles. A narrow woven fabric is a fabric of 3 inches or less in width having a selvage edge on either side which is trimmed away prior to spiral wrapping onto the brush core. A cut pile woven fabric is a fabric having pile yarns protruding from one face of the backing fabric where the pile yarns are cut upon separation of two symmetric fabric layers woven at the same time.

A general explanation of the weaving process is described below with reference to FIG. 3. In a preferred embodiment, a lubricant is applied as a fiber finish to the fibers at a suitable post coating stage in the manufacture of the brush to enhance high speed yarn handling characteristics. Typically, the lubricant may be applied prior to or during weaving or during brush shearing. Typically, materials that may be used as fiber finishes include mineral oils, hydrocarbon oils, silicones and waxes. Preferred commercially available materials include Stantex finishes, blends of mineral oil, fatty esters, non-ionic emulsifiers and low sling additives available from Henkel Corporation, Charlotte, N.C. and Permarin 206 a water emulsion of a fatty ethylenic copolymer available from National Starch & Chemical Company, Salsbury, N.C. In addition to assisting in the fabricating process, this treatment has the effect of reducing friction to minimize entanglements during use. Accordingly, the fiber to fiber, fiber to detoning roll, fiber to imaging member friction is reduced and radial shrinkage of the brush and detoning performance maintained to reduce the possibility of cleaning failure. Warp yarns for upper backing 90, lower backing 94, and pile 92 are wound on individual loom beams 96, 100 and 98, respectively. All yarns on the beams are continuous yarns having lengths of many thousands of yards and are arranged parallel to each other to run lengthwise through the resultant pile fabric. The width of the fabric, the size of warp yarns, and the number of warps "ends" or yarns per inch desired in the final fabric will govern the total number of individual warp yarns placed on the loom beams and threaded into the loom. From the loom beams, the yarns feeding the upper backing fabric 102, the lower backing fabric 104, and the pile 108 are led through a tensioning device, usually a whip roll and lease rods and fed through the eyes of heddles and then through dents in a reed 108. This arrangement makes it possible to manipulate the various warp yarns into the desired fabrics. As the warp yarns are manipulated by the up and down action of the heddles of the loom, they separate into layers creating openings called sheds. The shuttle carries the filling yarn through the sheds thereby forming the desired fabric pattern. The woven fabric having both an upper and lower backing 102, 104 with a pile 106 in between is cut into two fabrics by a cutter 110 to form two cut plush pile fabrics. A particularly preferred fabric is a cut plush pile woven fabric. Following weaving if the fabric has been woven on a wide loom leaving spaces between adjacent strips the fabric may be slit into strips by slitting the woven backing between the pile strips. Following the weaving techniques the fabric strips are coated with a conductive latex such as Emerson Cumming's Eccocoat SEC which is thereafter dried by heating. Thereafter the fabric strip is slit to the desired width dimension making sure not to cut into the region but coming as close to it as possible by conventional means such as by hot knife slitter, or by ultrasonic slitter.

The fabric strip is spirally wound onto the fabric core and held there with an adhesive to bind the fabric to the core. The width of the strip is dictated by the core size, the smaller cores generally require narrower fabric strips so it can be readily wrapped with automated winding machinery. The adhesive applied may be selected from readily available epoxies, hot melt adhesives, cyanoacrylics "instant type adhesives", or may include the use of double backed adhesive tape. In the case of liquid or molten adhesives, they may be applied to the fabric alone, to the core alone or to both and may be conductive or non-conductive. In the case of double backed tape, it is typically applied to the core material first. The winding process is inherently imprecise in that there is an inability to control the seam gap between fabric windings. This is because the fabric responds differently to tension by way of stretching, deforming or wrinkling. The fabric strip is wound in a constant pitch winding process whereby the spiral winding angle is based upon a knowledge of the core diameter and the fabric width. Typically, the core circumference is projected as a length running diagonally on the fabric from one edge to the other, and the winding angle is derived by this diagonal and the perpendicular between the two fabric edges.

With the decreased fineness as described herein, together with the increased fiber fill density, and decreased pile height and fiber diameter, provide miniature fibers which are suitable for use in a miniature brush used for cleaning in an electrostatographic printing or copying machine. Cleaning brushes using the miniature fibers exhibit in embodiments, unexpectedly superior cleaning ability by providing excellent cleaning of a member to be cleaned without causing abrasion to the member to be cleaned. Further, the fibers contained herein decrease the amount of toner left on the member to be cleaned. The fibers are also very durable, which results in increased cleaning life. Further, the miniature fibers and brushes are designed to operate efficiently at relativly low velocities, thereby enhancing their cleaning abilities.

All the patents and applications referred to herein are hereby specifically, and totally incorporated herein by reference in their entirety in the instant specification.

In the following examples, the compressive force to deform the fiber pile was measured. The compressive force can be measured in several ways. One common way is to secure a small round or square plate (about ½ inch square) to the end of a hand held force gauge and then bring the plate into increasing indenting contact with the pile fabric while noting the force as a function of penetration depth. Forces at approximately the same penetration depth will vary as a function of pile height, fiber size, fiber fill density and type of fiber. In general, for the same type of fiber, force decreases with decreasing fiber size (i.e., finer fibers are softer), decreasing fill density (fewer fibers create less resistance to penetration), and increasing pile height (long fibers bend easier than short ones). The process can be automated by use of an instron mechanical properties tester. Also, compression force can be measured by mounting a force gauge on the pivot points of the cleaner housing and noting the force on the entire brush as it is brought into contact with the photoreceptor or other member to be cleaned.

Another test was performed which measures the number of fiber strikes on a photoreceptor at relative velocities. In the examples below, fiber strikes were measured at a velocity of 300 rotations per minute using 10 μm toner.

A subjective test was also used to determine whether the brushes would be suitable for cleaning. The subjective test measures whether the fibers will be abrasive or cause damage to the photoreceptor or other member to be cleaned, or will be too soft, and therefore, unacceptable cleaning fibers. The subjective test used in the examples below was performed by simply pressing and running one's hand along the outer surface of the brush and noting the relative stiffness of the various pile fabrics. One of ordinary skill in the tactile measurement technique can easily predict what stiffness will be excessive for acceptable (i.e., low abrasion) rotational contact with the photoreceptor or other member to be cleaned. One of ordinary skill in this tactile measurement can also determine whether the fibers are too soft for acceptable cleaning performance. Similar subjective tests are used in the textile industry and are referred to as the "hand" or "drape" tests. These tests are also used in the art to measure the softness or pliability of a fabric or fibers.

The following examples further define and describe embodiments of the present invention. Unless otherwise indicated, all parts and percentages are by weight. Comparative Examples are also provided.

EXAMPLES

Comparative Example 1

An 11 denier electroconductive nylon 6 fiber (Resistat®), prepared by suffusing or pouring a mixture of fine particle size conductive carbon black and nylon power in a suitable solvent, was obtained from BASE Corporation of Enka, N.C. in the form of a 660 denier yarn consisting of 60 filaments and twisted to have 2.5 turns per inch twist. The yarns were woven into a fabric having 80,000 fibers per square inch by Schlegel Corporation of Rochester, N.Y. and then made into brushes having an outer diameter in the range of from about 25 to about 30 millimeters. Different pile fiber lengths were prepared to yield brush fiber lengths equal to 3.0, 5.0, 7.0, and 9.5 millimeters, respectively. Each brush was lo then evaluated for the apparent pile stiffness by a subjective test, was measured for the compressive force required to deform the brush pile, and was measured for the number of fiber strikes at 300 rpm with 10 μm toner on a photoreceptor. For fibers with pile lengths greater or equal to 9.5 millimeters, the stiffness was judged to be acceptable for use in a typical cleaner application. However, for fibers with the 7.0, 5.0 and 3.0 millimeter pile heights, the apparent stiffness was judged unsuitable for use as a xerographic cleaner where the requirement is for the brush to rotatively contact a polymeric type photoreceptor surface. The fibers having 3.0, 5.0, and 7.0 millimeter pile heights at 80,000 fibers per square inch, were judged to be highly likely to cause severe abrasion of the photoreceptor surface and create large drag forces that would make it difficult to precisely control the photoreceptor movement.

Table 1 below demonstrates that increasing the brush diameter to 30 mm and increasing the pile height to 9.5 results in a decrease in compression force, but the fiber strikes are not changed. These results are unfavorable. For adequate cleaning, it is important that if the compression force is decreased, the fiber strikes are increased. Fiber strikes listed are calculations of the theoretical maximum for the brushes identified. For the case where a 10 μm size toner adheres to the photoreceptor surface during passage through the entire nip region, and given the assumption that the toner is not removed by a previous fiber strike, the calculation describes the maximum number of fiber strikes the toner particle could be subjected to before removal. A fiber strike is a single filament making contact with the toner which removes toner from a surface such as a photoreceptor. A larger number of fiber strikes is preferred. Further, if the brush diameter is increased and the pile height is not, both compression force and fiber strike increase. The results shown below in Table 1 are unfavorable.

TABLE 1

| Fiber denier (dpf) | Fiber diameter (μm) | Brush Diameter (mm) | Pile Height (mm) | Weave Density (f/in$^2$) | Compr. Force (g) | Fiber Strikes for 10 μm toner |
|---|---|---|---|---|---|---|
| 11 | 37 | 25 | 7 | 80k | 395 | 14.3 |
| 11 | 37 | 30 | 7 | 80k | 528 | 22.6 |
| 11 | 37 | 30 | 9.5 | 80k | 169 | 14.5 |

Comparative Example 2

The same 11 denier fiber yarns from Example 1 were woven into other pile fabrics having 60,000 and 40,000 fibers per square inch, respectively and made into brushes having from about 25 to about 30 millimeter outer diameters from fabric pile lengths equal to those defined above and subjected to the above described tests for apparent stiffness. Even at a low fiber fill density equal to 40,000, the fibers having 3.0, 5.0, and 7.0 millimeter pile heights were deemed to be likely to abrade an organic photoreceptor and cause photoreceptor drag problems.

Comparative Example 3

Additional 11 denier fibers were obtained in the same yarn form, however, these fibers were prepared using the alternative melt spinning method described herein and woven into fabrics having the above defined fiber fill densities and pile lengths. When subjected to the above tests for apparent stiffness, each fiber having 3.0, 5.0, and 7.0 millimeter pile length, regardless of fiber fill density, was deemed unacceptable.

Thus from the above examples, it is clear that typically large denier (11 denier) nylon 6 fibers are not suitable for use in the preferred miniaturized cleaner brushes of future xerographic machines which will require pile fiber lengths of 9 millimeters or less and fiber fill densities greater than 40,000 fibers per square inch, and preferably greater than 60,000, and more preferably greater than 80,000 fibers per square inch.

The following examples demonstrate that brushes in conjunction with the present invention provide superior cleaning ability without problems of abrasion.

Example 4

A 5 denier electroconductive nylon 6 fiber was manufactured by BASF Corporation by the above described melt spinning process where the entire outer perimeter of the fiber comprised an electroconductive sheath of carbon black and nylon polymer. This material was supplied as a 660 denier yarn consisting of 132 individual filaments and twisted to a level of 2.5 turns per inch. The brushes used in examples were used herein except that the fiber fill density has changed to 88,000 fibers per square inch and 176,000 fibers per square inch, respectively. Each brush was then subjected to the test for apparent stiffness. The brushes with pile fiber lengths equal to 9.5 millimeters were judged acceptable and at the 5 and 7 millimeter pile lengths were judged to be conditionally acceptable.

As shown in Table 2 below, the 5 denier fibers demonstrate greatly reduced brush compression force as well as an increase in the fiber strikes. Low compression forces are important to reduce the drag of the brush on the photoreceptor. Further, an increase in fiber strikes increases the sufficiency of cleaning.

TABLE 2

| Fiber denier (dpf) | Fiber diameter (μm) | Brush Diameter (mm) | Pile Height (mm) | Weave Density (f/in$^2$) | Compressive Force (g) | Fiber Strikes for 10 μm toner |
|---|---|---|---|---|---|---|
| 5 | 25 | 25 | 7 | 80K | 82 | 14.3 |
| 5 | 25 | 25 | 7 | 176K | 179 | 31.4 |
| 5 | 25 | 25 | 5 | 176K | 561 | 45.3 |
| 5 | 25 | 25 | 7 | 176K | 240 | 49.7 |
| 5 | 25 | 30 | 9.5 | 176K | 77 | 31.9 |
| 5 | 25 | 30 | 9.5 | 80K | 35 | 14.5 |
| 5 | 25 | 30 | 5 | 176K | 684 | 63.8 |
| 5 | 25 | 30 | 8 | 176K | 151 | 42.6 |

As illustrated in Table 2 above, the best results were obtained by using 5 denier fibers in a brush having a diameter of 30 mm with a weave density of 176K.

Example 5

A 5 denier polyester conductive fiber yarn identical to that of Example 4 was obtained from the same source and manufactured into brushes as described above. Stiffness testing of these produced similar results as in Example 4. In this example, the fiber brush was comprised of polyester fibers. The rotational velocity for the fiber strikes was 300 rotations per minute (rpm), 2 mm brush to photoreceptor interference (BPI). Also, the modulus of elasticity for polyester ($E_{polyester}$) is equal to 1.39 modulus of elasticity for nylon ($E_{nylon}$). The results are shown below in Table 3.

TABLE 3

| Fiber Material | Fiber diameter (μm) | Brush Diameter (mm) | Pile Height (mm) | Weave Density (f/in$^2$) | Compr. Force (g) | Fiber Strikes for 10 μm toner |
|---|---|---|---|---|---|---|
| polyester | 25 | 25 | 7 | 176K | 233 | 10.25 |
| polyester | 25 | 30 | 7 | 176K | 313 | 15.90 |
| polyester | 25 | 30 | 9.5 | 176K | 100 | 10.22 |
| polyester | 25 | 30 | 9.5 | 80K | 46 | 4.65 |

Example 6

Several nylon fibers of different deniers were produced by BASF in the manner as described in Example 1 except that the fineness of the fibers ranged from 2 to 11. These fibers were formed into brushes of various weave densities. It was determined that the smaller denier fibers can be produced and that with these smaller fibers, larger weave densities can be achieved. The results are shown in Table 4 below. The results are based upon 300 rpm and 2 BPI.

TABLE 4

| Yam denier | Ends/ yam | Fiber denier | Fiber Diameter (μm) | Yam Diameter (μm) | Weave Density (f/in$^2$) |
|---|---|---|---|---|---|
| 660 | 60 | 11 | 37 | 300.95 | 80K |
| 660 | 132 | 5 | 25 | 300.95 | 176K |
| 660 | 165 | 4 | 22 | 300.95 | 220K |
| 660 | 220 | 3 | 19 | 300.95 | 293K |
| 660 | 330 | 2 | 16 | 300.95 | 440K |

From these examples, there was observed a clear trend to guide the selection of smaller denier fibers as the vehicle to obtaining the most desirable combination of higher fiber fill density, smaller brush outer diameter, shorter pile fiber length, smaller fiber diameter and acceptable stiffness.

Thus, electroconductive fibers with deniers less than 11, preferably 5 or less, demonstrate superior performance for use in miniaturized cleaning brushes by decreasing damage to the photoreceptor, decreasing the amount of residual tone left on the transfer surface providing extended cleaning life by providing durable fibers, and performing sufficiently at the desired relative velocities.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. A miniature cleaning brush, wherein said brush has a small diameter and comprises fine diameter electroconductive fibers comprising a filamentary polymer substrate with finely divided electrically conductive filler particles suffused through the filamentary polymer substrate and which filler particles are present within the filamentary polymer substrate as a uniformly dispersed phase adhered to the polymer substrate in an annular region located at the periphery of the fiber and extending inwardly along the diameter thereof, wherein said electrically conductive particles are present in an amount sufficient to render the electrical resistance of the fibers to be from about $1\times10^3$ ohms/cm to about $1\times10^{12}$ ohm/cm, and wherein said miniature brush has a fiber fill density of from about 60,000 to about 350,000 fibers per square inch.

2. The cleaning brush in accordance with claim 1, wherein said brush has a small diameter of from about 0.2 to about 1.25 inches.

3. The cleaning brush in accordance with claim 1, wherein said fine fibers have a diameter of from about 5 to about 38 microns.

4. The cleaning brush in accordance with claim 3, wherein said fibers have a diameter of from about 11 to 25 microns.

5. The cleaning brush in accordance with claim 1, wherein the fibers have a fineness of from about 0.1 to about 11 denier.

6. The cleaning brush in accordance with claim 5, wherein the fibers have a fineness of from about 0.5 to about 5 denier.

7. The cleaning brush in accordance with claim 6, wherein the fibers have a fineness of from about 0.7 to about 3 denier.

8. The cleaning brush in accordance with claim 1, wherein said fibers have an average pile height of from about 0.1 to about 20 millimeters.

9. The cleaning brush in accordance with claim 8, wherein said fibers have an average pile height of from about 0.5 to about 9 millimeters.

10. The cleaning brush in accordance with claim 1, wherein said miniature brush has a fiber fill density of from about 80,000 to 200,000 fibers per square inch.

11. The cleaning brush in accordance with claim 1, wherein the filamentary polymer substrate is selected from the group consisting of polyamides, polyester, polyethylene, polypropylene, aromatic polyesters, polyacrylonitriles, celluloses, rayons, acetates, and copolymers thereof.

12. The cleaning brush in accordance with claim 11, wherein the filamentary polymer substrate is selected from the group consisting of nylon 6, nylon 66, nylon 11, nylon 12, nylon 610, nylon 612, polyethylene terephthalate, polybutylene terephthalate, polyethylene oxybenzoate and copolymers thereof.

13. The cleaning brush in accordance with claim 12, wherein the filamentary substrate is selected from the group consisting of: a) copolymers of nylon, b) copolymers of nylon 6 and polybutylene terephthalate, and c) copolymers of nylon 66 and polybutylene terephthalate.

14. The cleaning brush of claim 13, wherein the filamentary substrate is a copolymer of nylon 6 and polybutylene terephthalate.

15. The cleaning brush in accordance with claim 1, wherein the electroconductive filler is selected from the group consisting of carbon black, iron oxide, tin oxide, polypyrrole and polyacetylene.

16. The cleaning brush in accordance with claim 15, wherein the electroconductive filler is carbon black.

17. The cleaning brush in accordance with claim 1, wherein the filler is present in an amount of from about 8 to about 75 percent by weight.

18. The cleaning brush in accordance with claim 17, wherein the filler is present in an amount of from about 10 to about 25 percent by weight.

19. The cleaning brush in accordance with claim 1, wherein said electrical resistance of said fibers is from about $1\times10^4$ to about $1\times10^{10}$ ohms/cm.

20. The cleaning brush in accordance with claim 19, wherein said electrical resistance is from about $1\times10^8$ to about $1\times10^{10}$ ohms/cm.

21. The cleaning brush in accordance with claim 1, wherein the fibers have an outer conductive layer that covers from about 99 to about 100 percent of the perimeter of the fiber.

22. A miniature cleaning brush for use in an image forming apparatus, wherein said brush has a small diameter and comprises fine diameter electroconductive fibers comprising a filamentary polymer substrate with finely divided electrically conductive filler particles suffused through the filamentary polymer substrate and being present within the filamentary polymer substrate as a uniformly dispersed phase adhered to the polymer substrate in an annular region located at the periphery of the filament and extending inwardly along the diameter thereof, wherein said electrically conductive particles are present in an amount sufficient to render the electrical resistance of the fibers to be from about $1\times10^3$ ohms/cm to about $1\times10^{12}$ ohm/cm, and wherein said miniature brush has a fiber fill density of from about 60,000 to about 350,000 fibers per square inch.

23. An image forming apparatus for forming images on a recording medium comprising:

a charge-retentive surface to receive an electrostatic latent image thereon;

a development component to apply toner to said charge-retentive surface to develop said electrostatic latent image to form a developed image on said charge retentive surface;

a transfer component to transfer the developed image from said charge retentive surface to a substrate; and a cleaning component for removing residual toner and debris from said charge-retentive surface after the developed image has been transferred thereon, said cleaning component comprising a miniature cleaning brush having a small diameter for use in said image forming apparatus comprising fine diameter electroconductive fibers, wherein said fibers comprise a filamentary polymer substrate having finely divided electrically conductive filler particles suffused through the filamentary polymer substrate and being present inside the filamentary substrate as a uniformly dispersed phase independent of the polymer substrate in an annular region located at the periphery of the filament and extending inwardly along the length thereof, wherein said electrically conductive particles are present in an amount sufficient to render the electrical resistance of the fiber from about $1\times10^3$ ohm/cm to about $1\times10^{12}$ ohm/cm, and wherein said miniature brush has a fiber fill density of from about 60,000 to about 350,000 fibers per square inch.

24. The image forming apparatus in accordance with claim 23, wherein the brush has a diameter of from about 0.2 to about 1.25 inches.

25. The image forming apparatus in accordance with claim 23, wherein said fibers have a fineness of from about 0.1 to about 11 denier.

26. The image forming apparatus in accordance with claim 23, wherein said fibers have a diameter of from about 5 to about 38 microns.

27. The image forming apparatus in accordance with claim 23, wherein said fibers have an average pile height of from about 0.1 to about 20 millimeters.

28. A miniature cleaning brush, wherein said brush has a small diameter and comprises fine diameter electroconductive fibers comprising a filamentary polymer substrate with finely divided electrically conductive filler particles suffused through the filamentary polymer substrate and being present inside the filamentary polymer substrate as a uniformly dispersed phase adhered to the polymer substrate in an annular region located at the periphery of the filament and extending inwardly along the diameter thereof, wherein said electrically conductive particles are present in an amount sufficient to render the electrical resistance of the fiber to be from about $1\times10^3$ ohms/cm to about $1\times10^{12}$ ohms/cm, wherein said brush has a diameter of from about 0.2 to about 1.25 inches, said fibers have a diameter of from about 5 to about 38 microns and a fineness of from about 0.1 to about 11 denier and an average pile height of from about 0.1 to about 20 mm, wherein said filamentary polymer is nylon 6 and said filler is carbon black.

* * * * *